US005134750A

United States Patent [19]

King et al.

[11] Patent Number: 5,134,750

[45] Date of Patent: Aug. 4, 1992

[54] CLEANER WITH CONVERSION VALVE ARRANGEMENT

[75] Inventors: Douglass A. King, North Canton; Edgar A. Maurer; Darwin S. Crouser, both of Canton; Charles R. Morrow, Alliance; Raymond L. Lawter, Millersburg, all of Ohio

[73] Assignee: The Hoover Company, North Canton, Ohio

[21] Appl. No.: 503,471

[22] Filed: Mar. 30, 1990

[51] Int. Cl.[5] ..... A47L 5/34

[52] U.S. Cl. ..... 15/333; 15/334; 15/356

[58] Field of Search ..... 15/332, 333, 337, 354, 15/355, 356

[56] References Cited

U.S. PATENT DOCUMENTS

| | | | |
|---|---|---|---|
| 2,202,982 | 6/1940 | Bell | 15/333 |
| 2,259,386 | 10/1941 | Luse | 15/333 |
| 2,325,821 | 8/1943 | White | 15/333 |
| 2,333,494 | 11/1943 | Snyder | 15/337 X |
| 2,372,033 | 3/1945 | Taylor | 15/333 |
| 2,606,337 | 8/1952 | Balluff | 15/337 |
| 2,644,976 | 7/1953 | Osborn | 15/333 |
| 2,719,319 | 10/1955 | Brace | 15/333 |
| 2,724,140 | 11/1958 | Daiger et al. | 15/333 |
| 4,171,554 | 10/1979 | Tschudy | 15/359 |
| 4,376,322 | 3/1983 | Lockhart et al. | 15/323 |
| 4,573,236 | 3/1986 | Dyson | 15/333 |
| 4,686,736 | 8/1987 | Petralia et al. | 15/332 |
| 4,811,452 | 3/1989 | Sumerau | 15/333 X |

*Primary Examiner*—William A. Cuchlinski, Jr.
*Assistant Examiner*—James K. Folker

[57] ABSTRACT

A cleaner suction nozzle is provided in which provisions are made for a nozzle height elevation arrangement and a hose conversion valve arrangement. The hose conversion valve arrangement works in conjunction with the nozzle height elevation arrangement so that the suction nozzle can be elevated from the floor to disengage the cleaner agitator and then hose conversion of the cleaner can occur almost simultaneously.

16 Claims, 8 Drawing Sheets

CLEANER WITH CONVERSION VALVE ARRANGEMENT

BACKGROUND OF THE INVENTION

1. Field of the Invention

This invention relates to vacuum cleaners and, more specifically, relates to a nozzle height adjustment and conversion valve arrangement which converts an upright vacuum cleaner for hose operation.

2. Summary of the Prior Art

The use of hose conversion valves with upright vacuum cleaners is old and well known. Conversion arrangements have taken many forms such as use of insertable conversion couplings for valve actuation, off the floor hose manipulation conversion, valve actuation manipulation, pedal conversion valve actuation, cleaner handle valve actuation and nozzle movement conversion valve actuation. Each of these conversion arrangements is also known where there is some incident of nozzle adjustment upwardly to move a cleaner agitator off the floor when converting to the hose mode. Heretofore, however, no known valve conversion arrangement has been devised which reciprocates so as to function most smoothly with a reciprocating type nozzle height elevation means.

Accordingly, it is an object of the invention to provide a reciprocating conversion valve operating in conjunction with a nozzle height elevation means.

It is an additional object of the invention to provide reciprocation nozzle height elevating means operative in conjunction with a conversion valve.

It is a still further object of the invention to provide an efficiently operating connecting arrangement disposed in driving relationship between a nozzle height elevating means and a cleaner conversion valve.

It is also a object of the invention to provide an improved cleaner conversion valve arrangement operating in conjunction with a nozzle height elevation means.

SUMMARY OF THE INVENTION

An upright cleaner suction nozzle is disclosed which conventionally rotatably mounts an agitator within a suction cavity formed at the front end of the nozzle. The suction nozzle is supported on wheels for easy traverse over a floor or rug including a pair of intermediately disposed wheels, mounted on a pivoting strut so as to provide for height adjustment of the nozzle. A stepped camming arrangement is mounted in a tracklike guide in the suction nozzle so as to be reciprocally movable transverse to the fore and aft direction of the nozzle to interpose itself between the nozzle body and the pivoting strut to move the pivoting strut with or against the weight of the nozzle body. A suction duct is disposed to extend along one side of the nozzle and communicates at its forward end with the agitation containing suction cavity. A gate valve is also mounted in a guide in the suction nozzle to move reciprocatorily within the nozzle body also transverse to its fore and aft direction to telescopically move into and out of the suction duct to open or close it. The gate valve is driven in its movement through an integral driving tab on it by reciprocal movement of the height adjustment arrangement for the nozzle by means of a driving connection therebetween. A lost motion mechanism is provided in this driving connection to accommodate final maximum height adjustment of the suction nozzle. An angled cam formed on the suction nozzle adjacent the guide for the gate valve permits the connecting means to override the driving tab during opening and closing of the gate valve to arrest its movement intermediate the width of the nozzle.

BRIEF DESCRIPTION OF THE DRAWINGS

Reference now may be had to the accompanying Drawings for a better understanding of the invention, both as to its organization and function, with the illustration being of a preferred embodiment, but being only exemplary, and in which.

DETAILED DESCRIPTION OF THE INVENTION

Figure 1:
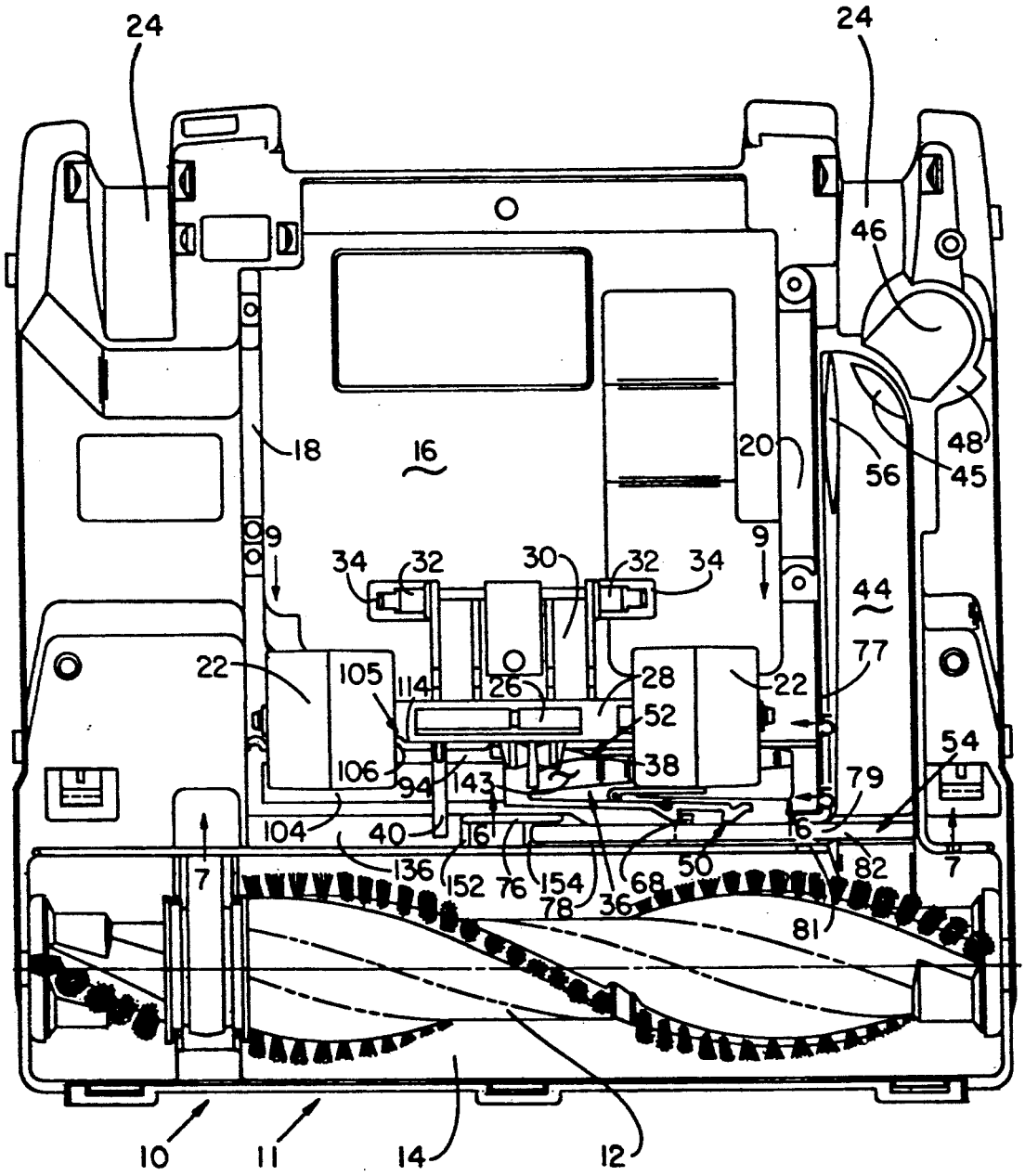
FIG. 1 is a bottom plan view of an upright cleaner suction nozzle incorporating the invention and with the bottom plate removed.

A vacuum nozzle 10 of a vacuum cleaner 11, best shown in FIG. 1, is disclosed which includes an agitator 12 disposed in the front of the nozzle in a suction chamber 14. A motor-fan housing cover well 16 obscures the downwardly depending motor and bag housing (neither shown) pivotally attached to vacuum nozzle on leftward and rightward trunnions 18, 20, riveted in enveloping relationship around similarly shaped lugs on the motor housing.

The suction nozzle 10 is supported for movement over a floor or carpet by intermediately disposed wheels 22, 22, serving as the front wheels of the cleaner 11 and disposed rearwardly of the agitator 12, and rear wheels (not shown) mounted, conventionally, in rear wheel wells 24, 24. The intermediately disposed wheels 22, 22 are pivotally mounted to suction nozzle 10 through a bracket 25. An axle 26 extends through an integral elongated tubular portion 28 of bracket 25 to mount the wheels 22, 22 outboard of the elongated tubular portion 28. Bracket 25 is roughly H-shaped with a thickened, ribbed cross bar 30 extending rearwardly from the elongated tubular portion 28. Cross bar 30 terminates in a pair of integral sidewardly extending pintles 32, 32 mounted in pivot pintle wells 34, 34 formed in vacuum cleaner nozzle 10 in housing cover well 16.

A nozzle height adjustment means 36 is interposed between the suction nozzle 10 and the pivoted wheel carrying bracket 25 to provide pivoting movement inwardly (upwardly) and outwardly (downwardly) of the wheels 22, 22 to raise or lower the vacuum cleaner nozzle 10 relative to its support surface. This height adjustment means bears against an integral upwardly or inwardly extending nose 38 formed at the front of the pivoting bracket 25, intermediate the ends of tubular portion 28. Adjustment of the wheels 22, 22 may also be had conventionally by a right angle crank link 40 pivoted (not shown) to the bracket 25 and abuttingly driven (by the motor housing) to pivot against the bracket 25 outwardly and force the wheels 22, 22 downwardly when the motor housing is placed in its storage position. A small upstanding support bracket 42, integral with pivoting bracket 25, pivotally mounts this crank link 40.

A duct 44 is also formed in the vacuum cleaner nozzle 10 which openly communicates with vacuum chamber 14 at a port 45 and extends rearwardly therefrom to terminate in an integral hose duct coupling elbow 46 that bends upwardly and extends through a top wall 48 of vacuum cleaner nozzle 10. The duct hose connecting elbow 46 is attachable, as is conventional, to a flexible hose or the like (not shown) for off the floor cleaning. The bottom or outerside of the duct 44 is formed by the covering bottom plate (not shown) of the vacuum cleaner nozzle 10.

A drive connecting means 50 (e.g., FIGS. 2–4), formed as an integral part of an actuating piece 52 of plastic which also contains, integrally, the nozzle height adjusting means 36, is disposed so as to engage a gate valve 54. This gate valve is movable into and out of the duct 44 to sealing close this duct relative to a fluid communication between it and agitator containing vacuum cleaner chamber 14. When this gate valve is closed, suction is applied solely to coupling elbow 46 (FIG. 1) and thereby available for off the floor cleaning through a suction port 56 leading to a fan (not shown) of the motor-fan system (not shown) of the cleaner 11. When the gate valve 54 is open, as is conventional, the end of the hose (not shown) attached to hose coupling elbow 46 must be sealed so full suction is available for cleaner floor operation.

Figure 7:
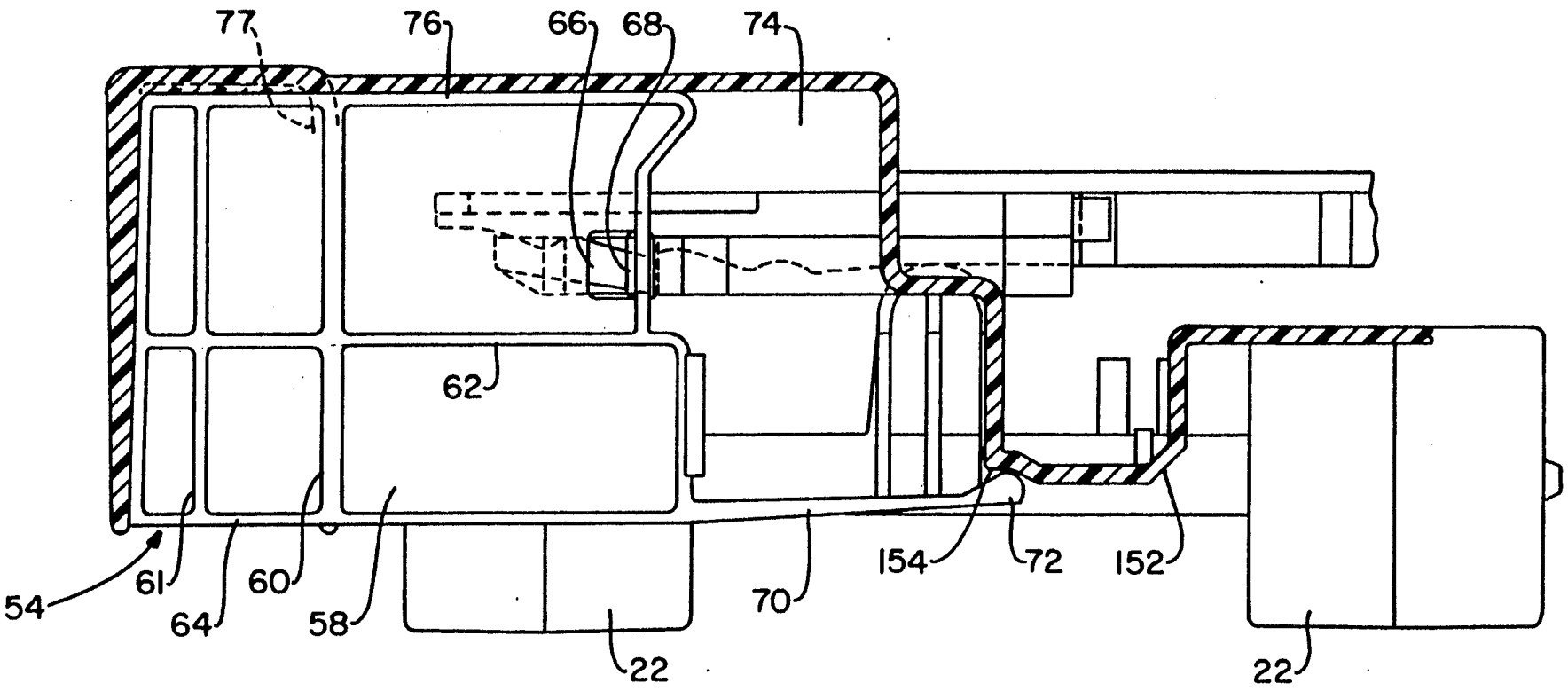
FIG. 7 is a front elevational, partially cross sectional view of the gate valve and its suction nozzle mounting taken on line 7—7 of FIG. 1.
Figure 8:
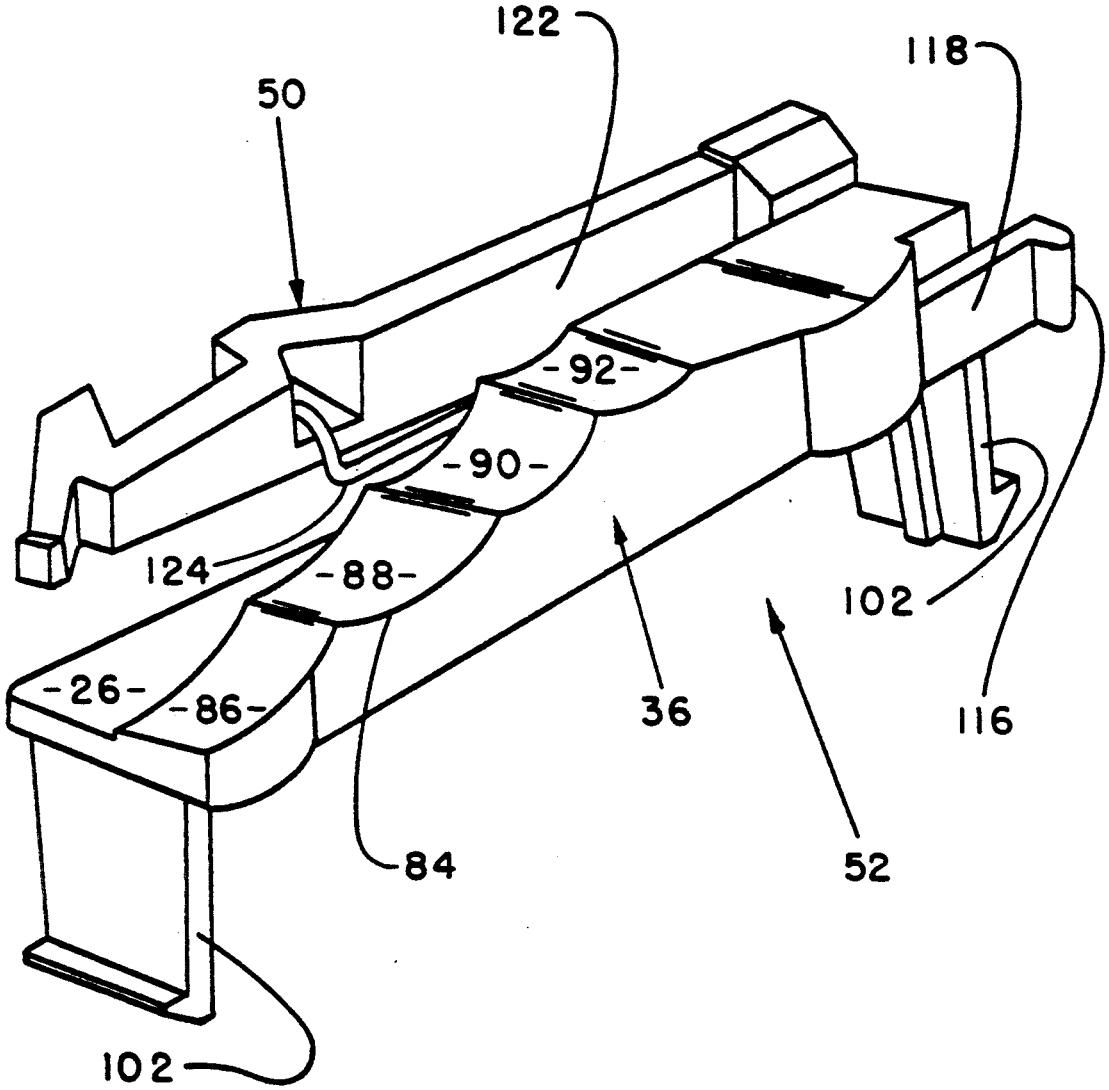
FIG. 8 is a rear perspective view of the height elevation means and driving connection structure of the instant invention, shown inverted with respect to its installed position.
Figure 9:
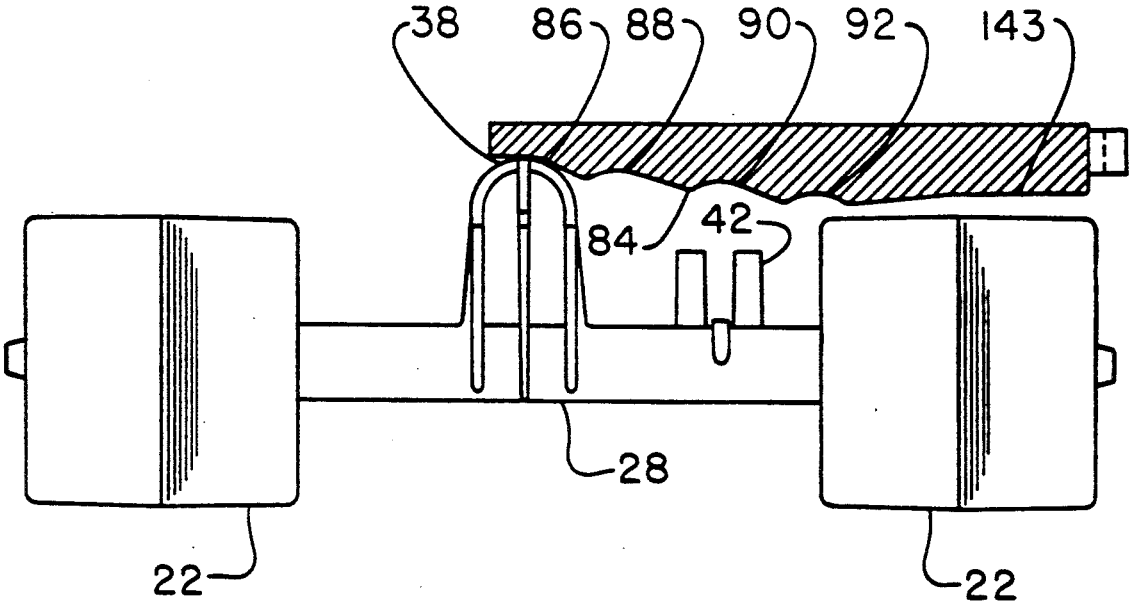
FIGS. 9–12 are partial fragmentary showings of the height elevation means of the invention taken looking in the direction of line 9—9 in FIG. 1 and showing higher and higher nozzle height adjustment in moving from FIG. 9–FIG. 12.
Figure 10:
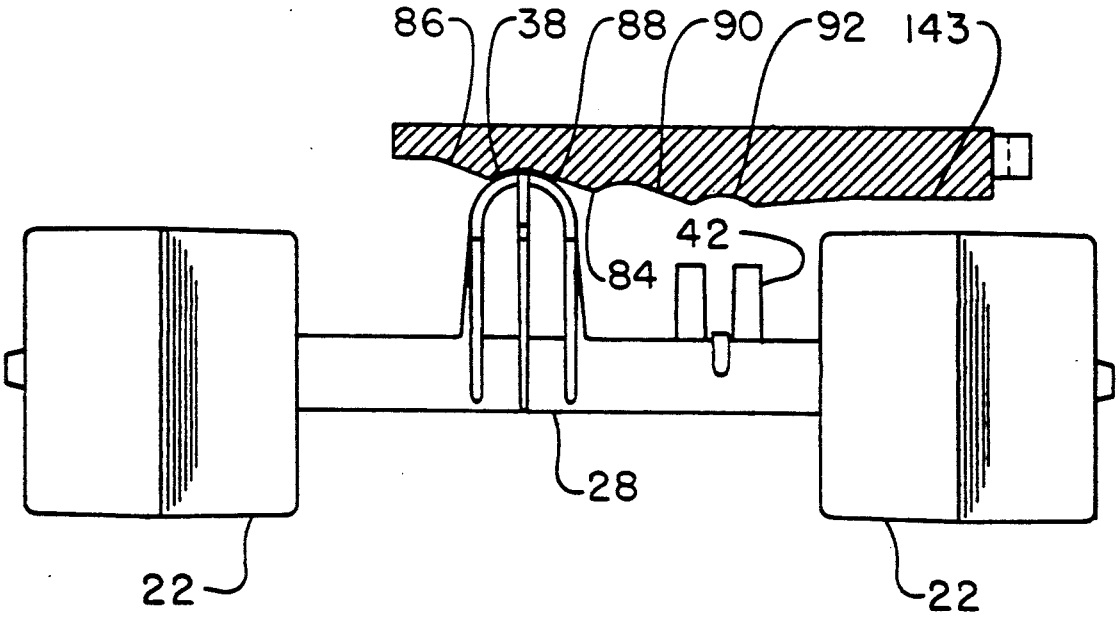
Figure 11:
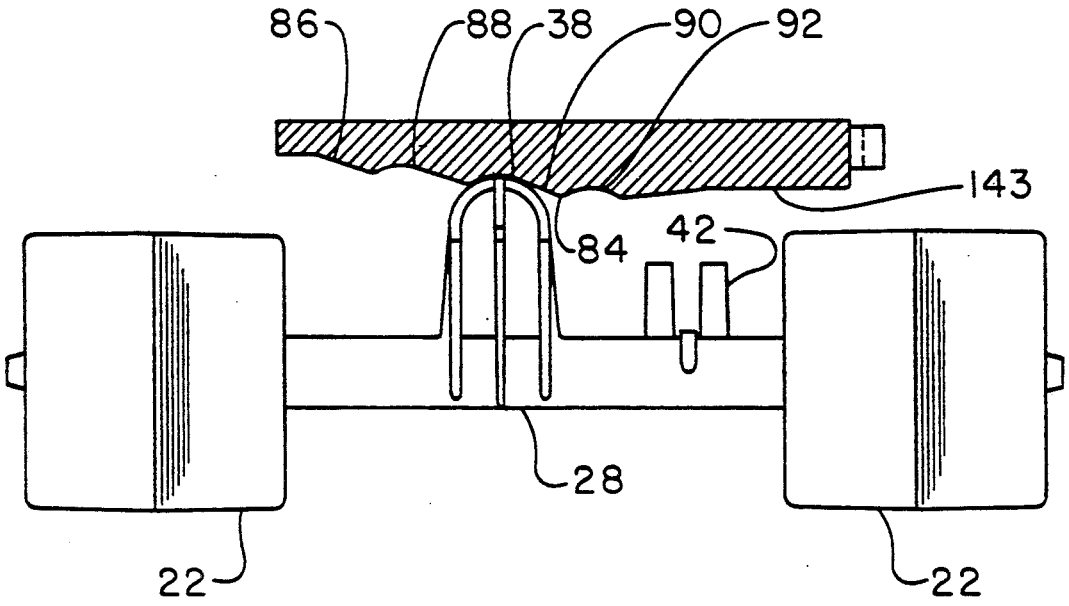
Figure 12:
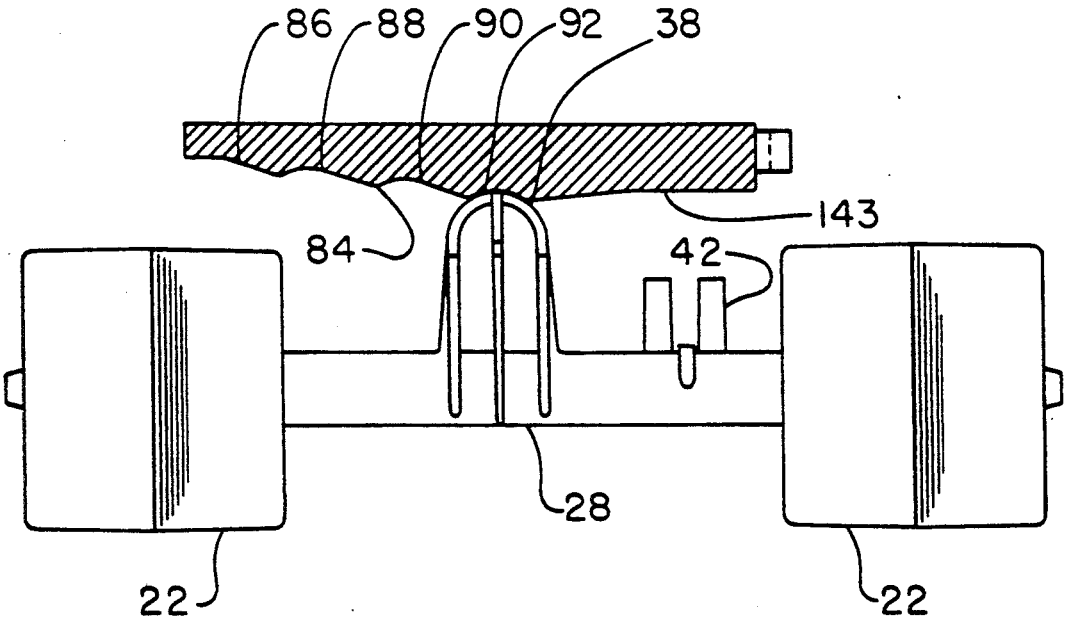

Gate valve 54 (FIG. 7) is generally formed by a vertically extending thin, ribbed face wall 58 having intermediate, vertically extending ribs 60, 61 and a transverse, intermediate, horizontally extending rib 62. A peripheral border 64 extends around face wall 58 to complete its outline. The ribs and border of gate valve 54 extend inwardly and outwardly, equally, relative to the planar extent of face wall 58 on both of its sides to strengthen it and to functionally cooperate with the suction nozzle 10 in which it is mounted. At the leftward or inner end of gate valve 54, face wall 58 includes a small rectangular aperture 66 intermediate its height. Immediately inwardly of the aperture and extending from the border 64 is disposed a short small tab 68 that extends in the aft direction of the vacuum nozzle 10. As will be apparent later, the tab serves as a detent arrangement for the drive connecting means 50 while the rectangular aperture serves as a clearance for molding. The gate valve 54 is generally completed by a leftwardly extending elongated tang 70 that includes at its end a thickened bulbous detent portion 72.

Gate valve 54 (FIG. 1) is guided in its reciprocating, rectilinear motion between open and closed position at its bottom by an upwardly opening guide track formed by a rearward spaced wall 74 of suction nozzle 10 and a vertically extending wall 78, forming the rear side of the agitator chamber 14, between which is disposed face wall 58 of gate valve 54. The walls 74 and 78 are spaced sufficiently far enough apart to provide a slight clearance beyond the thickness of the border 64 and rib 60 of face wall 58. At its top, gate valve 54 received guidance through the integral, transversely extending tang 70 (FIG. 7), riding in a track formed by the short depending wall 76 of suction nozzle 10 and the vertically extending wall 78, with this wall giving some guidance to the gate valve 54 nearly along its entire length.

At an inner side wall 77 of the duct 44 (FIGS. 2 and 3), near agitator chamber 14, additional guidance is afforded to the movement of the gate valve 54 by a slit 79 formed by a short vertically extending wall 80 parallel to and spaced from a downward step 81 (FIG. 1) of rear border wall 78 of agitation chamber 14. Between the two walls of the duct 44 a rectangular opening 82 communicates with the duct 44 and through this opening gate valve 54 reciprocates to open and close duct 44. The vertical rib 60 (FIG. 7) of gate valve 54 is disposed within slit 79 when the valve is closed, with this slit slightly wider than the rib 60, so that some sealing is obtained around gate valve 54. When the gate valve 54 is opened, the vertical, outer end portion of border 64 is disposed in this slit.

Figure 5:
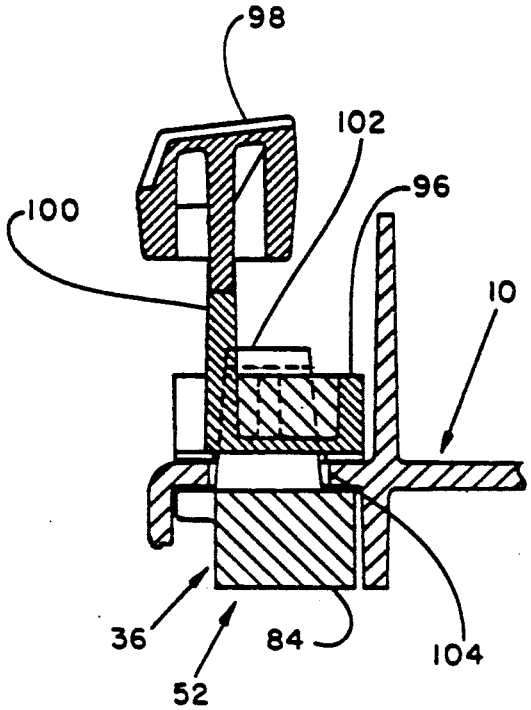
FIG. 5 is a partial side elevation cross sectional view of the invention taken generally on line 5—5 of FIG. 1 and showing the mounting of the height elevation mechanism and driving connection.
Figure 6:
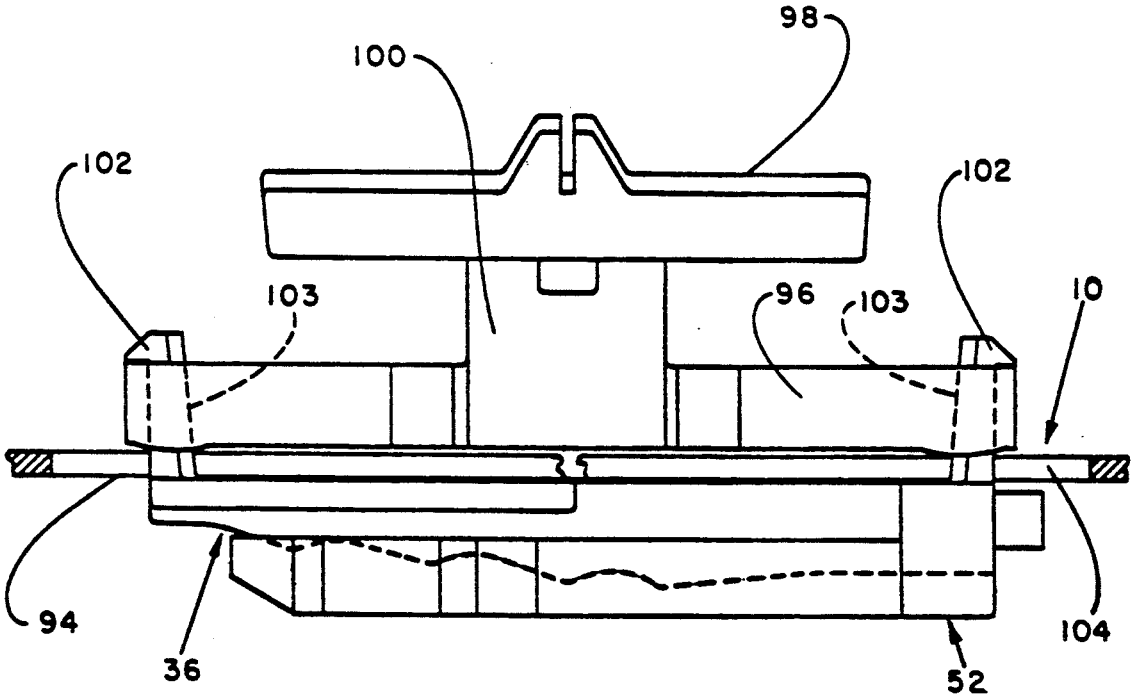
FIG. 6 is a front elevational view of the height elevation mechanism and driving connection taken on line 6—6 of FIG. 1.

The nozzle height adjusting means 36 (e.g., FIG. 3) includes a linear cam 84 having a series of concave cam steps 86, 88, 90 and 92 which adjust the wheels 22 inwardly and outwardly of the suction nozzle 10 as the distance set by the cam steps between a bottom side 94 of the nozzle 10 and the nose 38 on wheel carrying pivoted bracket 25 increases or decreases. Movement of linear cam 84 is occasioned by movement of a linear cam slider 96 FIGS. 5 and 6, disposed on the upper side of suction nozzle 10, and including an operator contactable slide piece 98 mounted therewith by a detenting arrangement (not shown) within the operator contactable slide piece 98. The slide piece 98 detentingly engages with an upstanding centrally located post 100 on the slider 96.

The slide 96 is abuttingly captivated to slide along the top surface of the suction nozzle 10 by attachment of it to the actuating piece 52 which is disposed on the opposite side of the suction nozzle 10. Connection between the slide 96 and the actuating piece 52 is afforded by a pair of barbed tangs 102, 102, integral with actuating piece 52 and extending downwardly from its ends and mountingly inserted into end, through apertures 103, 103 in slide piece 96. Clearance for the tangs 102, 102 in their movement across suction nozzle 10 is provided by an extending slot 104 formed in vacuum nozzle 10 and extending transversely along it, this slot and the portion of suction nozzle 10 forming the border between linear cam slider 96 and actuating piece 52 (i.e. linear cam 84) forming the guide for these two parts.

To arrest the movement of actuating piece 52 and provide positive dwell points for it as it translates across the suction nozzle 10 in effecting actuation of nozzle height adjusting means 36, a height elevation detent means 105 (FIG. 4) comprising a series of fixed detents 106, 108, 110 and 112 is formed on a cross piece 114, integral with and extending transversely across the suction nozzle above the wheels 22, 22. These detents corresponding, respectively, with cam steps 92, 90, 88, and 86 and their engagement with nose 38. An engaging tab 116, cantilever mounted on a transversely extending, integral arm 118 of actuating piece 52 engages in these detents. Due to the inherent resiliency of the plastic actuating piece 52 and the fact that the arm 118 is in compressed condition as it rides along the cross piece 114 positive engagement occurs.

A generally, somewhat similar detented nozzle height adjusting arrangement is shown in U.S. Pat. No. 4,171,554, issued Oct. 23, 1979 and owned by a common assignee.

In order to provide for a positive dwell point at the location of the actuating piece 52 in the suction nozzle 10 when the gate valve 54 is in closed position relative to the duct 44 an additional detent 120 is formed in cross piece 114, rightwardly removed from the detents 106, 108, 110, and 112. Detent 120 corresponds to the gate valve close position.

The drive connecting means 50 works in the following manner. When the actuating piece 52 has moved rightwardly so as to place cam step 92 beneath nose 38 (highest nozzle elevation) and engage tab 116 in detent 106 and raise the nozzle 10 to its maximum height (FIG. 3), an integral contilevered arm 122 of actuating piece 52 which extends transversely along its front side is beginning to move to a position to engage tab 68 of gate valve 54 to close it.

Figure 2:
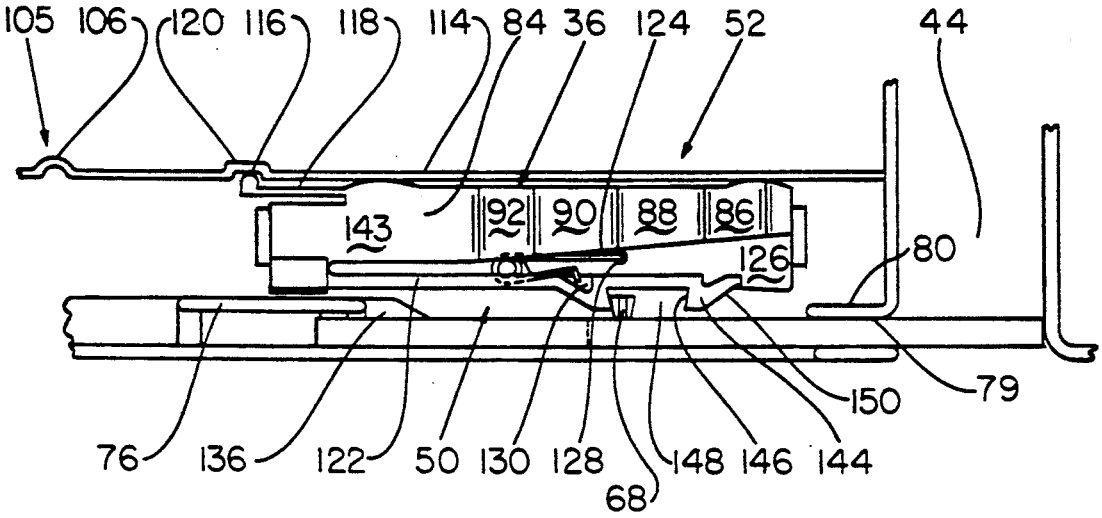
FIG. 2 is a partial plan view of the structure showing portions of the height elevation means, driving connection and gate valve in closed position.

Integral cantilevered arm 122 is spring baised forwardly by a torsion spring 124 acting between a flat 126 in actuating piece 52, through mounting hole 128 in it, and cantilevered arm 122 having a notch 130 in which a spring end 132 of torsion spring 124 engages. This spring forces cantilevered arm 122 against the rear side of the short vertical guidance wall 76 or an extension wall 136 stepped down from but inwardly flush with it. This occurs by abutment of a forward integral projection 134 of cantilevered arm 122, alternately, against one of them. The wall 136, at its rightward end, terminates in a cam face 138 that angles outwardly to terminate adjacent the back side of the gate valve 54. Thus, movement of drive connecting means 50 rightwardly from the FIG. 3 position causes projection 134 and a cam slanting face 140 on projecton 134 to move outwardly along cam face 138, as driven by torsion spring 124, until a flat face 142 of projection 134 is far enough outwardly displaced to engage tab 68 of gate valve 54 (FIG. 4). Then, movement of the drive connecting means 50 further rightwardly drive the gate valve 54 to closed position in the duct 44 (FIG. 2).

Figure 3:
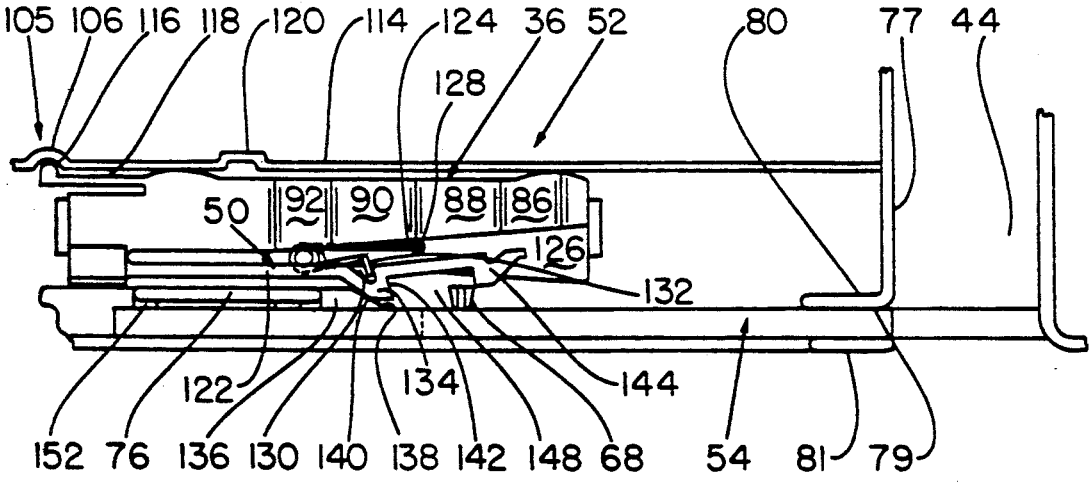
FIG. 3 is a view similar to the full line position of FIG. 2 but showing the driving connection only moved partly up the camming ramp.
Figure 4:
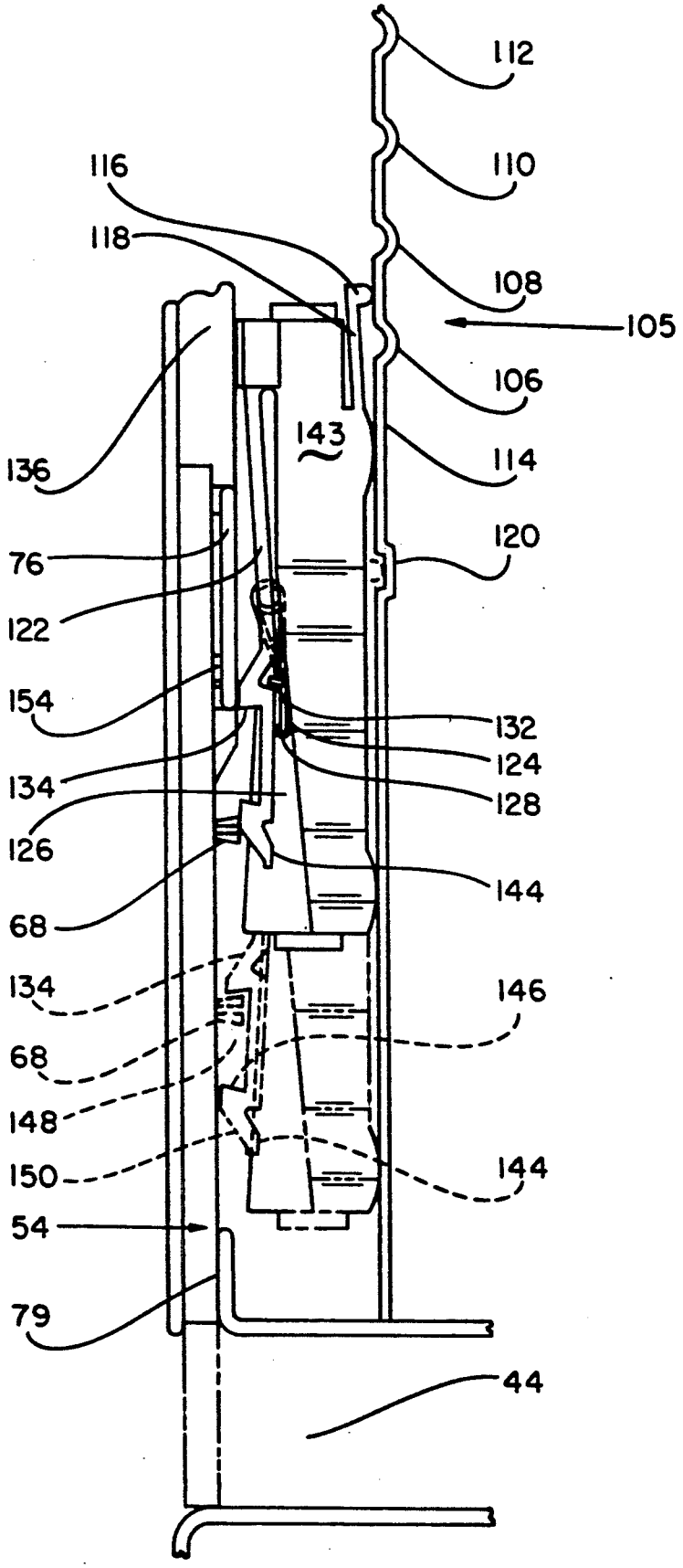
FIG. 4 is a similar view of the height elevation means, driving connection and gate valve with the dashed line position showing a slight leftward movement of the height elevation means and driving connection in a gate valve opening direction and with the full line position showing the height elevation means and driving connection removed from and overriding the gate valve driving tab to permit further adjusting movement of the height elevation means leftwardly.

Movement of the nozzle height adjusting nose 38 rightwardly past the maximum height position of FIG. 3 is along a flat face extension 143 of linear cam 84.

Movement of gate valve 54 leftwardly to open position is occasioned by a second, integral projection 144 situated rightwardly of spaced from projection 134 on cantilever arm 122. Projection 144 (FIG. 4) also includes a flat face 146, with flat face 146 confronting flat face 142 to form an elongated cam dwell slot 148 therebetween. Projection 144 is shaped with a smooth leading edge 150 at its forward, rightward side to guide this projection rightwardly over tab 68 in the event of misassembly of the nozzle height adjustment means 36 and gate valve 54. Since the cam dwell slot 148 provides a dead space between the faces 142, 146 initial leftward opening movement of the drive connecting means 50 from valve closed position (dashed position FIG. 4) does not initiate opening of valve gate 54 until face 146 engages the rightward side of gate valve tab 68.

Projection 134 through its abutting flat face 146 then remains engaged with valve gate projection 68 until valve gate 54 is again opened. At this time, cam slanting face 140 of drive connecting means projection 134 again moves against cam face 138 to force rearward pivoting movement of cantilevered arm 122 (FIG. 3) and driving disengagement of projection 144 with tab 68. Further movement of drive connecting means 50 leftwardly leaves the gate valve 54 in an open, stable position while drive connecting means projection 144 passes inwardly behind gate valve tab 68 and drive connection projection 134 slides in abutting relationship against the rear side of wall 136 (full line position, FIG. 4). The gate valve 54 remains open while the actuating piece 52 shifts farther leftwardly so that the nozzle height adjusting means 36 may place the suction nozzle 10 in a lower and lower position.

The structure of the invention is completed by a pair of dwell detents 152, 154 (FIG. 7), formed on the bottom side of the track between short vertical guide wall 76 and rear border wall 78 of agitator chamber 14. These detents are engaged by bulbous portion 72 of integral gate valve 54, through elongated tang 70, to thereby provide for more substantial positive location of gate valve 54 at its limits of travel.

It should be clear that the structure described fully fulfills the objects of the invention set out at the beginning of the Specification and the invention advantageously provides a combined nozzle height elevation arrangement and valve conversion arrangement. Also, not in limitation but as an example, a releasable camming arrangement has been devised so that the "throw" necessary for height adjustment of the nozzle does not require the provision of tracking means and clearances for the movable valve closure across most of the nozzle width and the consequent complications and weakening of the body structure of the suction nozzle. Also, an engaging projection arrangement that positively engages the valve closure member in both directions of its movement has been devised. But, at the same time, a dwell spot has been built into the projection arrangement to accommodate the spatial requirements for operation of the releasing valve closure cam arrangement. Accordingly, in view of the description offered, many modifications to the invention could occur to one skilled in the art which would still fall within its spirit and purview.

What is claimed:

1. A suction cleaner having a nozzle and a suction passageway extending to an agitator chamber for said suction cleaner including:

a) a means for closing said suction passageway, b) said means for closing said suction passageway including a moving means for mounting a pivotal engagement arm, said moving means movable with respect to said suction passageway, c) a means for elevating and lowering said nozzle, d) means for manually actuating said elevating and lowering means, e) said means for elevating and lowering said nozzle driving said means for closing said passageway,
f) said means for manually actuating said elevating and lowering means moving rectilinearly,
g) whereby manual actuation of said elevating and lowering means is capable of effecting closure of said suction passageway.

2. The suction cleaner as set out in claim 1 wherein;
a) said means for elevating and lowering said nozzle includes a movable, linear cam, and
b) said movable, linear cam directly drives said engaging arm along a guidance means.

3. The suction cleaner as set out in claim 2 wherein;
a) said movable linear cam also directly drives said engaging arm as it opens and closes said valve.

4. The suction cleaner as set out in claim 2 wherein;
a) said linear cam is integrally attached to said engaging arm,
b) said integral attachment pivoting said engaging arm to said linear cam.

5. The suction cleaner as set out in claim 4 wherein;
a) said engaging arm is spring urged into engaging position by a spring operative between said engaging arm and said linear cam.

6. The suction cleaner as set out in claim 5 wherein;
a) said spring is a torsion spring with its reaction points at said engaging arm and said linear cam.

7. The suction cleaner as set out in claim 1 wherein;
a) said engagement arm includes at least a single engaging and disengaging projection,
b) said means for closing said suction passageway also includes a closure member,
c) said closure member includes a means for engagement by said single engaging and disengaging projection.

8. The suction cleaner as set out in claim 7 wherein;
a) said nozzle includes a guidance means for guiding movement of said engagement arm,
b) said engaging projection of said engagement arm engaging said means for engagement of said closure member when said engagement arm clears said guidance means.

9. The suction cleaner as set out in claim 7 wherein;
a) said engaging arm includes a second engaging projection,
b) said engaging projections being spaced along said engaging arm, and
c) one of said projection engaging said closure member to move it to open position and one of said projections engaging said closure member to move it to closed position.

10. The suction cleaner as set out in claim 9 wherein;
a) a guidance means is provided that includes an angled cam face,
b) said angled cam face guiding said engaging arm into a position to enable engagement and disengagement of said projections with said closure member.

11. The suction cleaner as set out in claim 1 wherein;
a) said engaging arm is spring urged into its engaging position.

12. A suction cleaner having a nozzle and a suction passageway extending to an agitator chamber for said suction cleaner including;
a) a means for closing said suction passageway,
b) a means for raising and lowering said nozzle,
c) said means for closing said suction passageway including a closure member,
d) a driving connection between said means for closing said suction passageway including said closure member and said means for raising and lowering said nozzle for movement together,
e) a means for interrupting at least said drive between said means for raising and lowering said nozzle and said closure member to effectively disengage said closure member from at least a part of the movement of said means for raising and lowering said nozzle said interruption means being structurally situated between said closure means and said means for raising and lowering said nozzle, and
f) said closure member only moving with respect to said suction passageway when said drive is engaged.

13. The suction cleaner as set out in claim 12 wherein;
a) said closure member includes detentable means for limiting its opening and closing directions, and
b) detent means fixed on said nozzle for engagement by said detent means.

14. The suction cleaner as set out in claim 12 wherein;
a) said means for interrupting said drive includes a guidance cam.

15. The suction cleaner as set out in claim 14 wherein;
a) said closure member is directly driven by a pair of spaced means for engagement with it and comprising a portion of said means for closing said suction passageway, and
b) said spaced means for engagement are spaced to accommodate an operative length of said guidance cam.

16. A suction cleaner having a nozzle and a suction passageway extending to an agitator for a suction cleaner including;
a) a means for closing said suction passageway to put said cleaner in an off the floor operating mode,
b) a single means including only one operator contactable member for raising and lowering said nozzle,
c) said single means including said only one operator contactable member being the sole means for raising and lowering said nozzle,
d) a driving connection between said means for closing said suction passageway and said single means for raising and lowering said nozzle for movement together,
e) said driving connection being intermittent whereby one of said single means for raising and lowering said nozzle and said means closing said suction passageway does not move during at least a portion of the movement of the other,
f) said means for closing said passageway including a closure member, and
g) said closure member being generally unbiased and nonspring urged to either of its open or closed positions.

* * * * *